US008353104B2

(12) United States Patent
Chen

(10) Patent No.: US 8,353,104 B2
(45) Date of Patent: Jan. 15, 2013

(54) MANUFACTURING METHOD OF CONDUCTING WIRE TERMINAL

(75) Inventor: Yung-Chou Chen, Ta Li (TW)

(73) Assignee: Uta Auto Industrial Co., Ltd., Ta Li (TW)

( * ) Notice: Subject to any disclaimer, the term of this patent is extended or adjusted under 35 U.S.C. 154(b) by 635 days.

(21) Appl. No.: 12/539,334

(22) Filed: Aug. 11, 2009

(65) Prior Publication Data

US 2011/0036900 A1 Feb. 17, 2011

(51) Int. Cl.
*H01R 43/04* (2006.01)

(52) U.S. Cl. ..... 29/862; 29/511; 29/514; 29/859

(58) Field of Classification Search ..... 29/862, 29/511, 514, 517, 753, 861, 863, 865, 859; 72/412, 474; 174/84 C, 84 R, 87, 90, 94 R
See application file for complete search history.

(56) References Cited

U.S. PATENT DOCUMENTS 2,478,082 A * 8/1949 Broske ..... 174/84 C
5,167,066 A 12/1992 McEnroe
5,749,756 A * 5/1998 Vockroth et al. ..... 439/879

FOREIGN PATENT DOCUMENTS

TW 419156 1/2001
TW 456076 9/2001

* cited by examiner

*Primary Examiner* — Thiem Phan
(74) *Attorney, Agent, or Firm* — Wang Law Firm, Inc.; Li K. Wang; Stephen Hsu

(57) ABSTRACT

A method of manufacturing a conducting wire terminal includes the steps of: preparing a strip tube of a predetermined length; boring both ends of the strip tube separately, such that a body is formed between both ends of the strip tube and has a diameter smaller than both ends of the strip tube, and the copper sleeve is accommodated in the body; and compressing an intersection of both ends of the strip tube and the body, such that a circular tapered neck is formed at the intersection of both ends of the strip tube and the body, and a circular slanting guide surface is formed separately on opposite internal surface of each tapered neck of the strip tube.

1 Claim, 7 Drawing Sheets

MANUFACTURING METHOD OF CONDUCTING WIRE TERMINAL

BACKGROUND OF THE INVENTION

1. Field of the Invention

The present invention relates to a terminal, in particular to a method of manufacturing a conducting wire terminal.

2. Description of the Related Art

In general, two conducting wires are connected to increase the length of a conducting wire according to actual requirement of a site for the installation of the conducting wire, and a conducting wire terminal is usually provided for connecting the two conducting wires. However, a conventional manufacturing method of the conducting wire terminal mainly uses a plastic injection molding machine to integrally form a tube having two openings 71 disposed apart from each other, a body 72 disposed between the two openings 71 and having a smaller diameter than the two openings 71, and a copper sleeve 73 installed in the body 72 (as shown in FIG. 7) to form a conducting wire terminal.

Limited by a small volume of the conducting wire terminal, the conducting wire terminal can only be manufactured in a simple form by the plastic injection molding machine, and a vertical stairway section 74 will be formed at the intersection of the two openings 71 and the internal surface of the copper sleeve 73, and the stairway section 74 will become an obstacle for installing a copper wire 76 of the conducting wire 75, and affect a smooth assembling operation. If the conducting wire 75 is composed of a plurality of copper wires 76, the external periphery of the copper wires 76 may be bent easily by the stairway section 74 to affect the electric conduction power adversely.

SUMMARY OF THE INVENTION

It is a primary objective of the present invention to provide a method of manufacturing a conducting wire terminal with the advantages of a low manufacturing cost, an improved smooth installation of the conducting wire terminal, an enhanced working efficiency, and a highly stable electric conduction after the conducting wire terminal is connected to the conducing wire.

To achieve the foregoing objective, the present invention provides a method of manufacturing a conducting wire terminal, wherein a strip tube of a predetermined length is prepared, and both ends of the strip tube are bored, and a body is formed between both ends of the strip tube and has a diameter smaller than both ends of the strip tube, and a copper sleeve is installed in the body of the strip tube, and an intersection of both ends of the strip tube and the body is compressed, such that a circular tapered neck is formed at the intersection of both ends of the strip tube and the body, and a circular slanting guide surface is formed separately on opposite internal sides of each tapered neck of the strip tube, so as to complete manufacturing the conducting wire terminal of the present invention.

The present invention further provides a method of manufacturing a conducting wire terminal, wherein a strip tube of a predetermined length is prepared, and a copper sleeve is installed in the stripe tube, and both ends of the strip tube are bored, and a body is formed between both ends of the strip tube and has a diameter smaller than both ends of the strip tube, and the copper sleeve is accommodated in the body, and an intersection of both ends of the strip tube and the body is compressed, such that a circular tapered neck is formed at the intersection of both ends of the strip tube and the body, and a circular slanting guide surface is formed separately on opposite internal sides of each tapered neck of the strip tube, so as to complete manufacturing the conducting wire terminal of the present invention.

The present invention further provides a method of manufacturing a conducting wire terminal, wherein a strip tube of a predetermined length is prepared, and a copper sleeve is installed in the stripe tube, and appropriate positions at both ends of the strip tube are compressed, such that a circular tapered neck is formed separately at both ends of the strip tube, and a circular slanting guide surface is formed separately on opposite internal sides of each tapered neck of the strip tube, and the copper sleeve is disposed between the slanting guide surfaces inside the two tapered necks, so as to complete manufacturing the conducting wire terminal of the present invention.

The present invention further provides a method of manufacturing a conducting wire terminal, wherein a strip tube of a predetermined length is prepared, and a copper sleeve is installed in the stripe tube, and both ends of the strip tube are tapered, such that the diameter of both ends of the strip tube is smaller than the diameter of the body with the copper sleeve installed therein, and both ends of the strip tube are bored, such that a circular tapered neck is formed separately at both ends of the strip tube, and a circular slanting guide surface is formed separately on opposite internal sides of each tapered neck of the strip tube, so as to complete manufacturing the conducting wire terminal of the present invention.

DETAILED DESCRIPTION OF THE PREFERRED EMBODIMENTS

Figure 1:
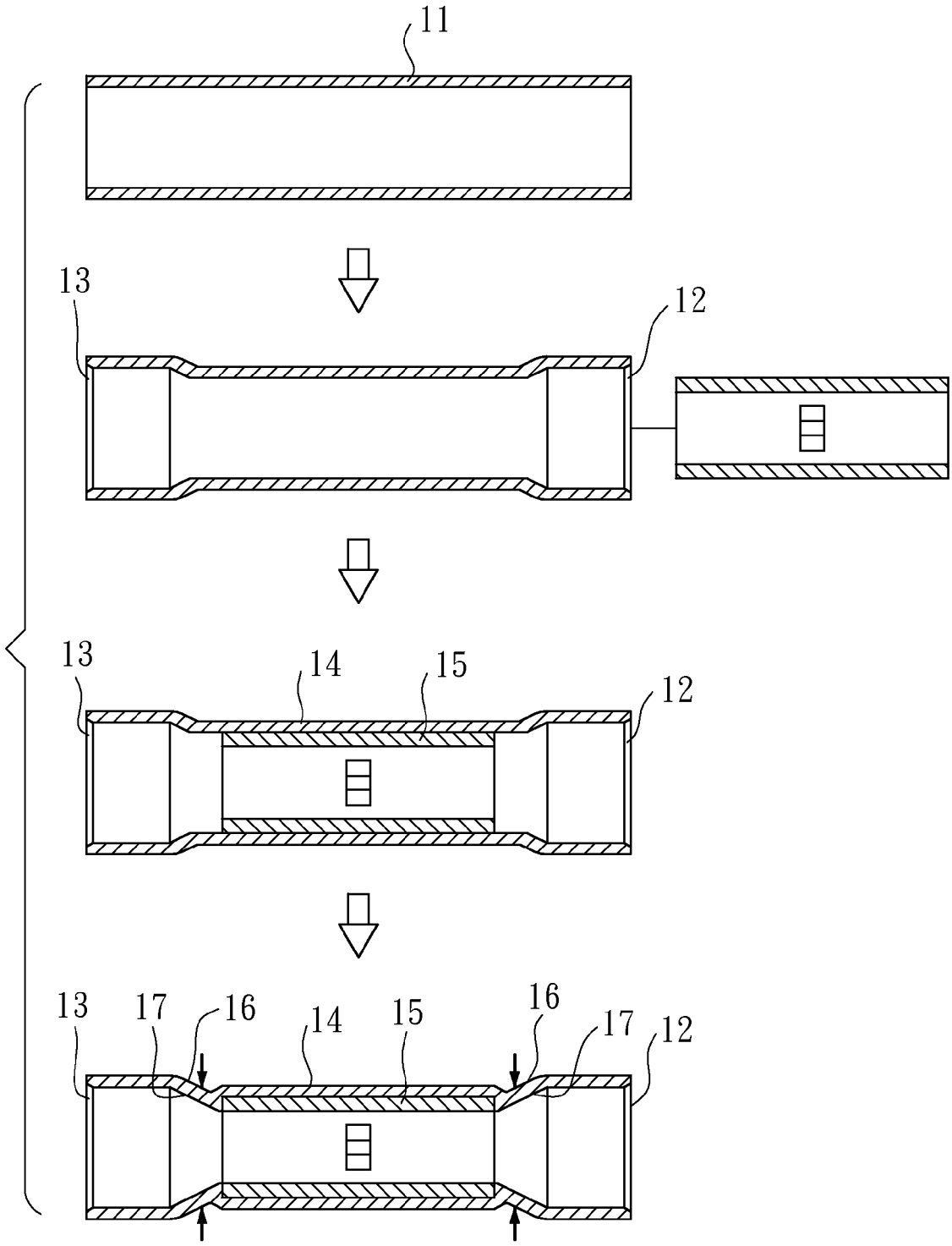
FIG. 1 is a flow chart of a manufacturing method in accordance with a first preferred embodiment of the present invention.

With reference to FIG. 1 for a flow chart of a manufacturing method in accordance with a first preferred embodiment of the present invention, the manufacturing method comprises the following steps:

A pipe drawing and shaping machine is used for manufacturing a strip tube 11 of a predetermined length, and an opening 12, 13 is formed separately at both ends of the strip tube 11.

A boring machine is used for drilling openings 12, 13 at both ends of the strip tube 11 respectively, such that a body 14 is formed between both ends of the strip tube 11 and has a diameter smaller than the openings 12, 13 disposed at both ends of the strip tube 11.

A copper sleeve 15 is prepared and installed into the body 14 of the strip tube 11 through one of the openings 12, 13 of the strip tube 11.

A compression equipment is used for applying a compression force onto an intersection of both ends of the strip tube 11 and the body 14, such that a circular tapered neck 16 is formed at the intersection of both ends of the strip tube 11 and the body 14, and a circular slanting guide surface 17 is formed separately on opposite internal sides of each tapered neck 16 of the strip tube 11, so as to complete manufacturing the conducting wire terminal of the present invention.

Figure 2:
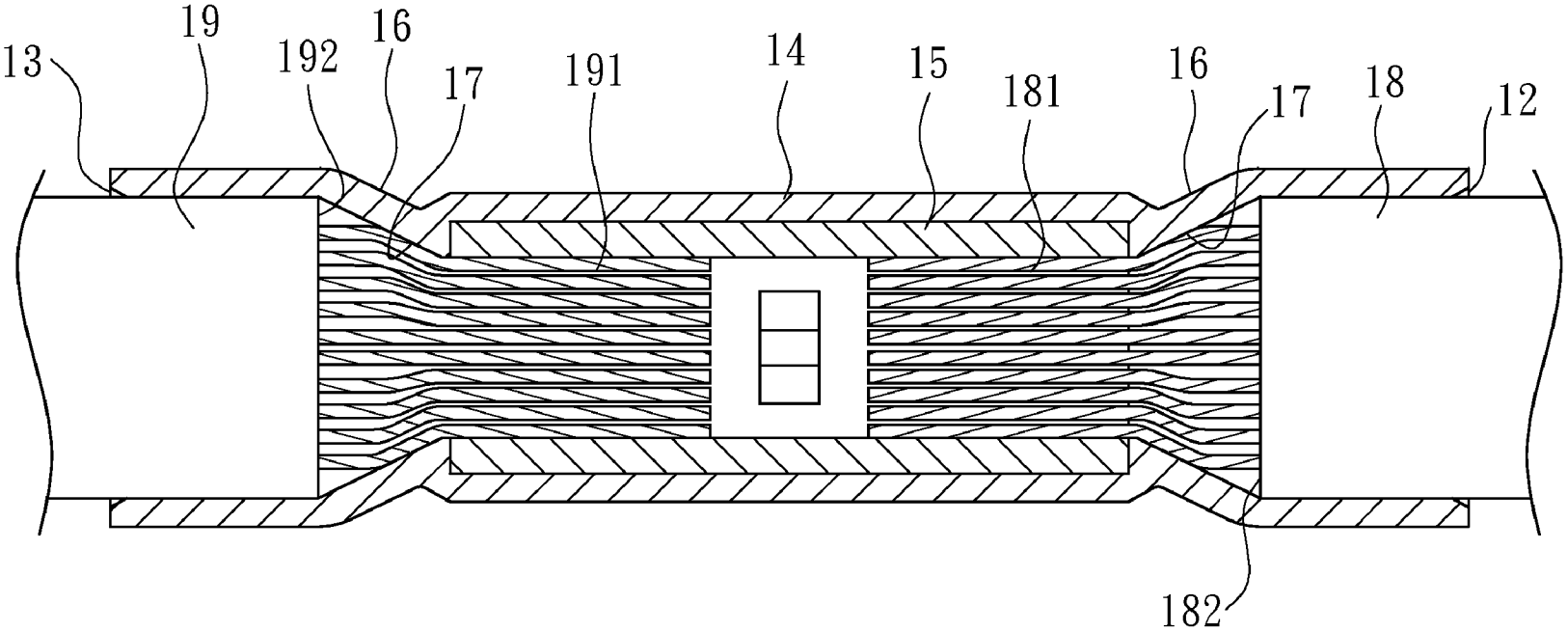
FIG. 2 is a schematic view of using a conducting wire terminal in accordance with a first preferred embodiment of the present invention.

In an application of the conducting wire terminal in accordance with the present invention as shown in FIG. 2, two opposite conducting wires 18, 19 are installed into the copper sleeve 15 through the openings 12, 13 disposed at both ends of the conducting wire terminal, and a circular slanting guide surface 17 formed on an internal side of the conducting wire terminal is provided for guiding copper wires 181, 191 of each conducting wire 18, 19 into the copper sleeve 15, so as to prevent the conducting wires 18, 19 from being hindered during the installation of the conducting wires 18, 19, and enhance the working efficiency of users. Since the circular slanting guide surface 17 can guide the copper wires 181, 191 of the conducting wires 18, 19 into the copper sleeve 15 completely, and a jacket 182, 192 of each conducting wire 18, 19 is stopped by the circular slanting guide surface 17, such that the conducting wire 18, 19 cannot be entered into the copper sleeve 15, therefore the invention can assure a stable electric conduction after the two conducting wires 18, 19 are connected.

In addition, the present invention does not use the injection molding machine for the manufacture, and thus saves the cost of making a mold, and the pipe drawing and shaping machine costs less than the injection molding machine, and thus the invention can lower the manufacturing cost of the conducting wire terminal significantly.

Figure 3:
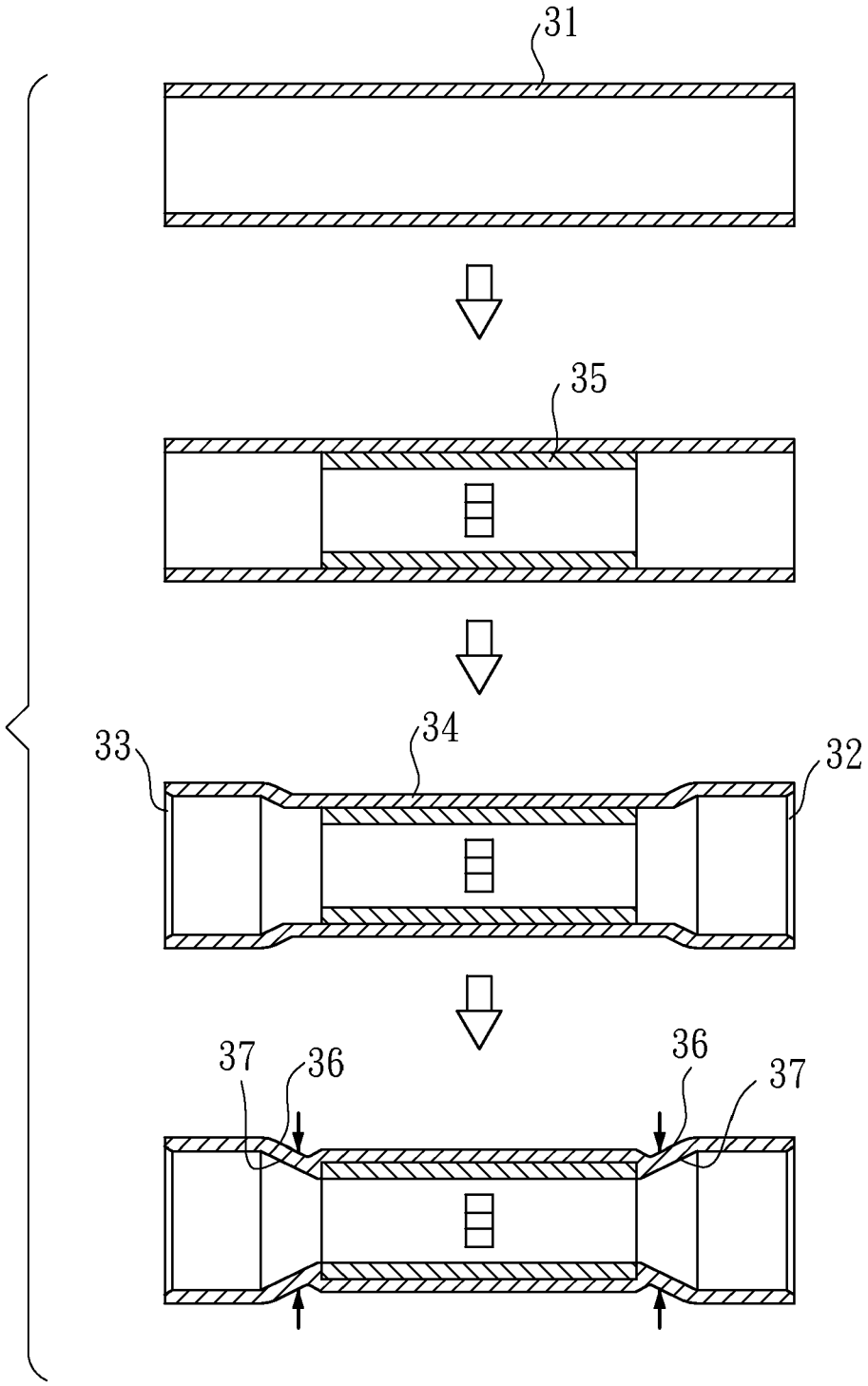
FIG. 3 is a flow chart of a manufacturing method in accordance with a second preferred embodiment of the present invention.

With reference to FIG. 3 for a flow chart of a manufacturing method in accordance with a second preferred embodiment of the present invention, the manufacturing method similarly comprises the steps of: preparing a strip tube 31 of a predetermined length; installing a copper sleeve 35 into the strip tube 31; boring both ends 32, 33 of the strip tube 31, such that a body 34 is formed between both ends 32, 33 of the strip tube 31 and has a diameter smaller than both ends 32, 33 of the strip tube 31, and the copper sleeve 35 is accommodated in the body 34; and compressing an interaction of both ends 32, 33 of the strip tube 31 and the body 34, such that a circular tapered neck 36 is formed at the intersection of both ends 32, 33 of the strip tube 31 and the body 34, and a circular slanting guide surface 37 is formed separately on opposite internal sides of each tapered neck 36 of the strip tube 31, and the conducting wire terminal manufactured by the aforementioned method can achieve the same effects of the first preferred embodiment.

Figure 4:
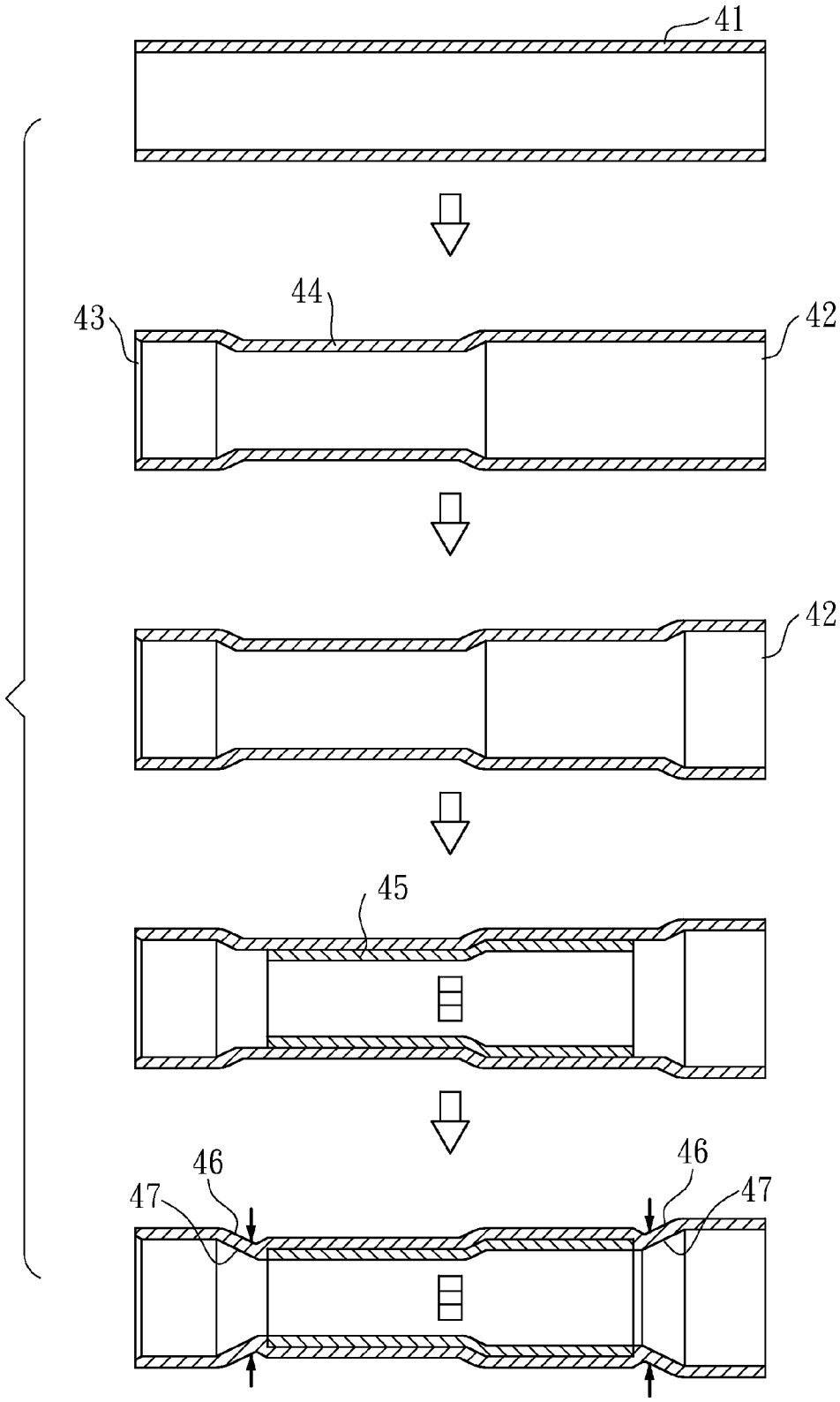
FIG. 4 is a flow chart of a manufacturing method in accordance with a third preferred embodiment of the present invention.

With reference to FIG. 4 for a flow chart of a manufacturing method in accordance with a third preferred embodiment of the present invention, the manufacturing method copes with different types of copper sleeves, and thus at least one end of the strip tube 41 is bored for more than one time, and a stairway-shaped opening 42 is formed at an end of the strip tube 41 for installing copper sleeves 45 of different specifications, and the intersection of the openings 42 at both ends of the strip tube 41 and the body 44 is compressed to manufacture a conducting wire terminal having the same effects of the aforementioned preferred embodiments.

Figure 5:
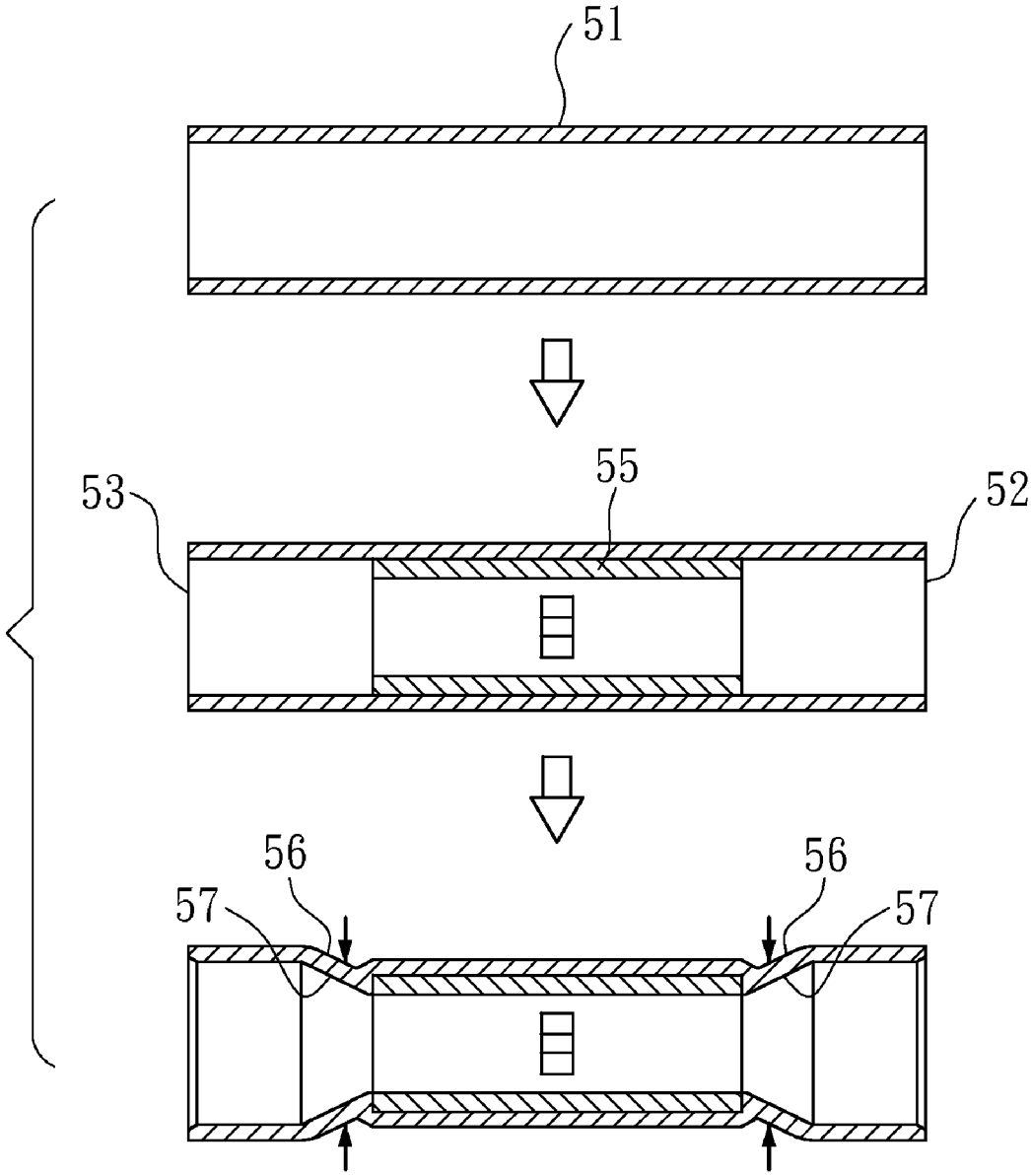
FIG. 5 is a flow chart of a manufacturing method in accordance with a fourth preferred embodiment of the present invention.

With reference to FIG. 5 for a flow chart of a manufacturing method in accordance with a fourth preferred embodiment of the present invention, the manufacturing method comprises the steps of: preparing a strip tube 51 of a predetermined length; preparing and installing a copper sleeve 55 into the strip tube 51; and compressing appropriate positions at both ends 52, 53 of the strip tube 51, such that a circular tapered neck 56 is formed separately at both ends 52, 53 of the strip tube 51, and a circular slanting guide surface 57 is formed separately on opposite internal sides of each tapered neck 56 of the strip tube 51, and the copper sleeve 55 is situated between slanting guide surfaces 57 on internal sides of the two tapered necks 56. Since both ends of the conducting wire terminal manufactured by the aforementioned method are not bored, therefore the conducting wire terminal can be used for connecting a conducting wire having a thinner jacket.

Figure 6:
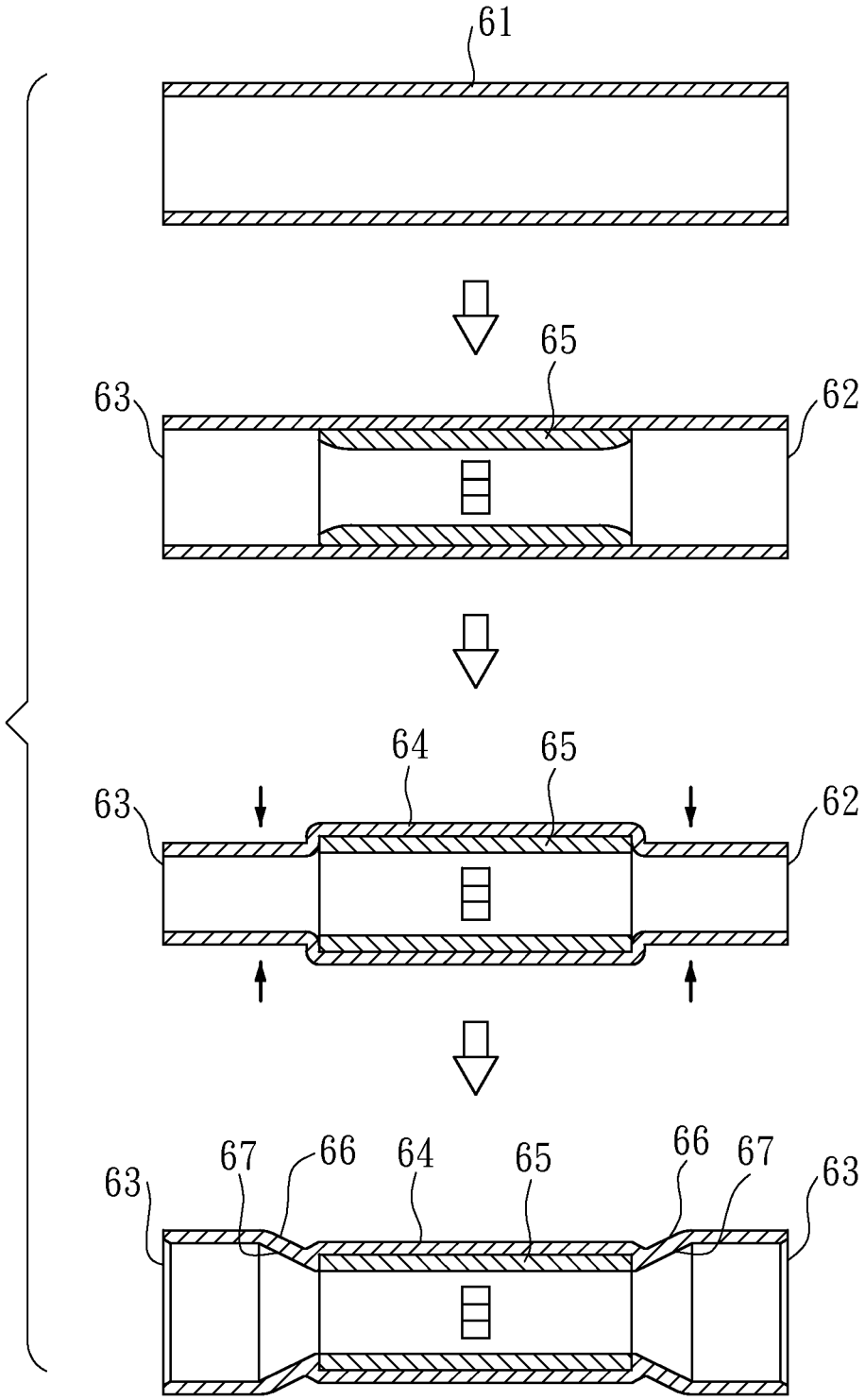
FIG. 6 is a flow chart of a manufacturing method in accordance with a fifth preferred embodiment of the present invention.
Figure 7:
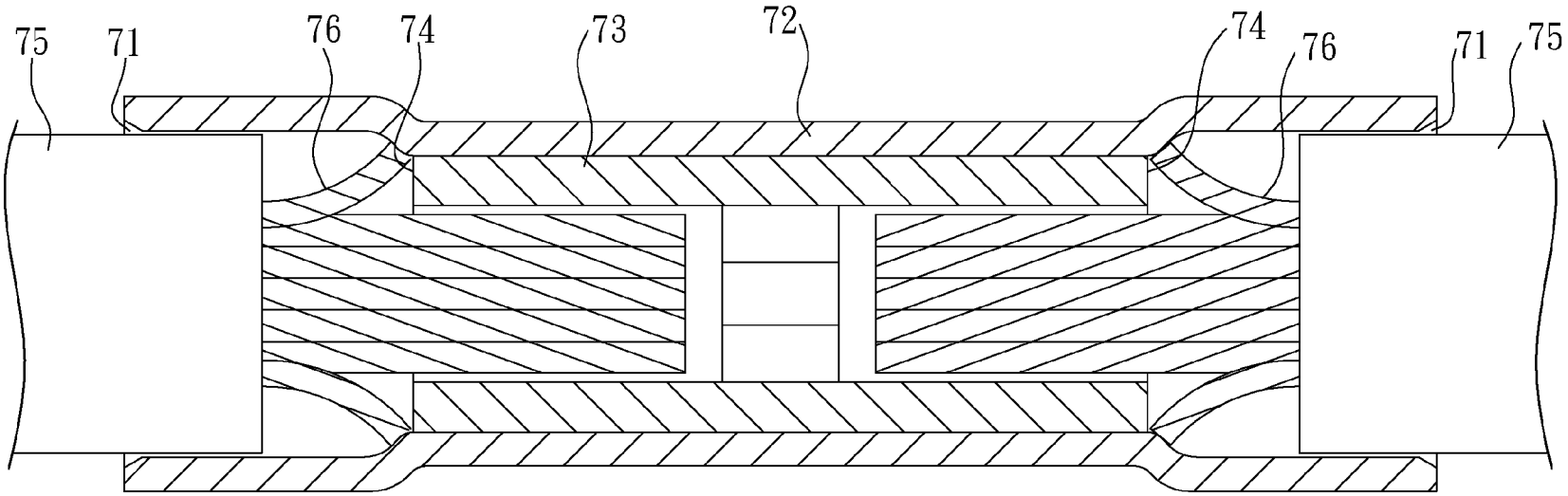
FIG. 7 PRIOR ART
FIG. 7 is a schematic view of applying a conventional conducting wire terminal.

With reference to FIG. 6 for a flow chart of a manufacturing method in accordance with a fifth preferred embodiment of the present invention, the manufacturing method similarly comprises the steps of: preparing a strip tube 61 of a predetermined length; installing a copper sleeve 65 into the strip tube 61; tapering both ends 62, 63 of the strip tube 61, such that both ends 62, 63 of the strip tube 61 have a diameter smaller than the diameter of the body 64 of the copper sleeve 65; and boring both ends of the strip tube 61, such that a circular slanting guide surface 67 is formed separately on opposite internal surface of each tapered neck 66 of the strip tube 61, and the copper wires of the conducting wires of the conducting wire terminal can be guided completely into the copper sleeve 65, so as to improve the working efficiency of users. It is noteworthy to point out that the compression on the neck made by the compression equipments in accordance with the foregoing preferred embodiments can be roll pressing, clamping or squeezing.

What is claimed is:

1. A method of manufacturing a conducting wire terminal, comprising the steps of:

preparing a strip tube of a predetermined length, the strip tube having a first end and a second end;

installing a copper sleeve inside the strip tube, the copper sleeve having a diameter;

tapering both ends of the strip tube, such that a body is formed on the strip tube, between the first end and the second end, and each end of the strip tube has a diameter smaller than the diameter of the copper sleeve; and boring both ends of the strip tube, such that a circular tapered neck is formed at each end of the strip tube, and a circular slanting guide surface is formed on each circular tapered neck of the strip tube.

* * * * *